US006607077B2

(12) United States Patent
Feeney

(10) Patent No.: US 6,607,077 B2
(45) Date of Patent: Aug. 19, 2003

(54) GOLF RACK BAG

(76) Inventor: Philip Edward Feeney, 16 Kenmar Dr., Unit 123, Billerica, MA (US) 01821

( * ) Notice: Subject to any disclaimer, the term of this patent is extended or adjusted under 35 U.S.C. 154(b) by 0 days.

(21) Appl. No.: 10/063,158

(22) Filed: Mar. 26, 2002

(65) Prior Publication Data

US 2003/0047472 A1 Mar. 13, 2003

Related U.S. Application Data

(63) Continuation-in-part of application No. 09/682,505, filed on Sep. 10, 2001.

(51) Int. Cl.[7] ..... A63B 55/00

(52) U.S. Cl. ..... 206/315.7; 206/315.3; 206/315.2; 294/143

(58) Field of Search ..... 206/315.7, 315.2, 206/315.3; 211/70.2; 294/143; 224/198, 918

(56) References Cited

U.S. PATENT DOCUMENTS

| | | | | | |
|---|---|---|---|---|---|
| 2,070,254 | A | * | 2/1937 | Burgner | 211/70.2 |
| 2,990,865 | A | * | 7/1961 | Steele | 211/70.2 |
| 3,953,033 | A | * | 4/1976 | Kellye et al. | 211/70.2 |
| 4,036,416 | A | * | 7/1977 | Lowe | 211/70.2 X |
| 4,230,247 | A | * | 10/1980 | Lowe | 294/143 |
| 4,666,038 | A | * | 5/1987 | Minneman | 206/315.2 |
| 4,779,914 | A | * | 10/1988 | Friedline | 294/143 |
| 6,032,999 | A | * | 3/2000 | York et al. | 294/143 |

* cited by examiner

*Primary Examiner*—Tri M. Mai

(57) ABSTRACT

The Golf Rack Bag is a golf club holder that is easily carried by a golfer with a full complement of clubs and accessories. Each club is secured yet readily accessible. The holder itself is very stable, light, and easily picked up and placed down without stooping or activating moving parts. The unique design of the Golf Rack Bag places the weight of the clubs on the golfers center of gravity and away from the golfers back.

1 Claim, 3 Drawing Sheets

14
13
18
12

18
8
19

48
2
1
3
44
49
10
11
44
12
A
A
21
18
6
21
44
7
B
B
47
8
19
13
38
4
20
5
20

GOLF RACK BAG

BACKGROUND OF INVENTION

Golfers normally want a full complement of clubs and accessories with them when playing golf such that they always have the right club, enough balls and tees, towel, divot tool, greens marker, umbrella, windbreaker or sweater available when needed. Golfers who carry their bag are assured of having what they need available at all times.

The USGA (The United State Golf Association) rules allow up to 14 clubs; however, carrying clubs using current golf bags, which have club dividers and bag stands, are heavy and awkward. Often a golfer switches from carrying a bag to driving or pulling a cart because of the weight and awkwardness of carrying golf bags.

The awkwardness of carrying current golf bags results from different situations:

1) The collapsible bag stand at times hits golfers in the heel of their foot and trips them when they are preoccupied with their game while walking.
2) Golfers place the bag on the fringe upright, often times using a built in stand, when they arrive at the green. Normally there is some slope to the fringe and when the golfer is putting, the bag may fall making a lot of noise due to a slight gust of wind and/or the slope was too uneven for the upright golf bag. Many golfers avoid this mishap by placing the bag lengthwise on the fringe but this requires stooping to pick the golf bag up and often times a wet or dirty bag spoils the golfer's pants.
3) Golfers know what club they want but cannot find it in the bag.
4 Often times they find the club but they cannot pull it out easily without dislodging several other clubs.
5) Golfers shun distractions and many bags cause the clubs to bang together and make noise under normal operation.
6) Golf club shafts are often made of graphite and can be scored if allowed to rub against plastic bag dividers.
7) Carrying too many clubs is a penalty according to USGA scoring rules and sometimes golfers forget and leave a practice club in the bag and do not notice it until they tee off thereby incurring a penalty.

The weight burden for a golfer carrying a bag is stressful and constant. Today, more people are health conscious and desiring to exercise but no one wants to hurt their back carrying a golf bag.

The Golf Rack Bag contains all that the bag-carrying golfer needs and it is 20% of the weight of a traditional carrying golf bag, with collapsible stand and golf club separator devices, and has none of the awkwardness listed above. In fact, it is very comfortable and distributes the weight of the clubs to the golfers center of gravity and not to the golfers back. The Golf Rack Bag, although different in appearance from a traditional golf bag, is pleasing to the eye.

SUMMARY OF INVENTION

A holder for a full complement of clubs and accessories protected from the ground surface, which is easily carried on either shoulder and placed down or picked up without stooping. A club is selected when carrying the Golf Rack Bag on the shoulder or when the Golf Rack Bag is placed on end to return a club.

The benefits of this invention are that the design produces a lightweight carrier that distributes the weight of the clubs away from the golfer's back to the golfer's center of gravity, is very stable at rest on any incline even with gusty winds, and each club is securely attached yet readily available. The design lends itself to placing accessories along the spine, storing the umbrella and clothing inside the holder and is easily adjustable for transportation and storage.

The golfer carrying the Golf Rack Bag will experience clean contact with the carrier, less noise, less fatigue, more carrying comfort, easier picking up and placing the bag in the most uneven terrain such as near bunkers, less distractions due to the quietness of the Golf Rack Bag in operation, and quicker club selection than using traditional carrying bags.

DETAILED DESCRIPTION

Figures 1, 1A, 1B:
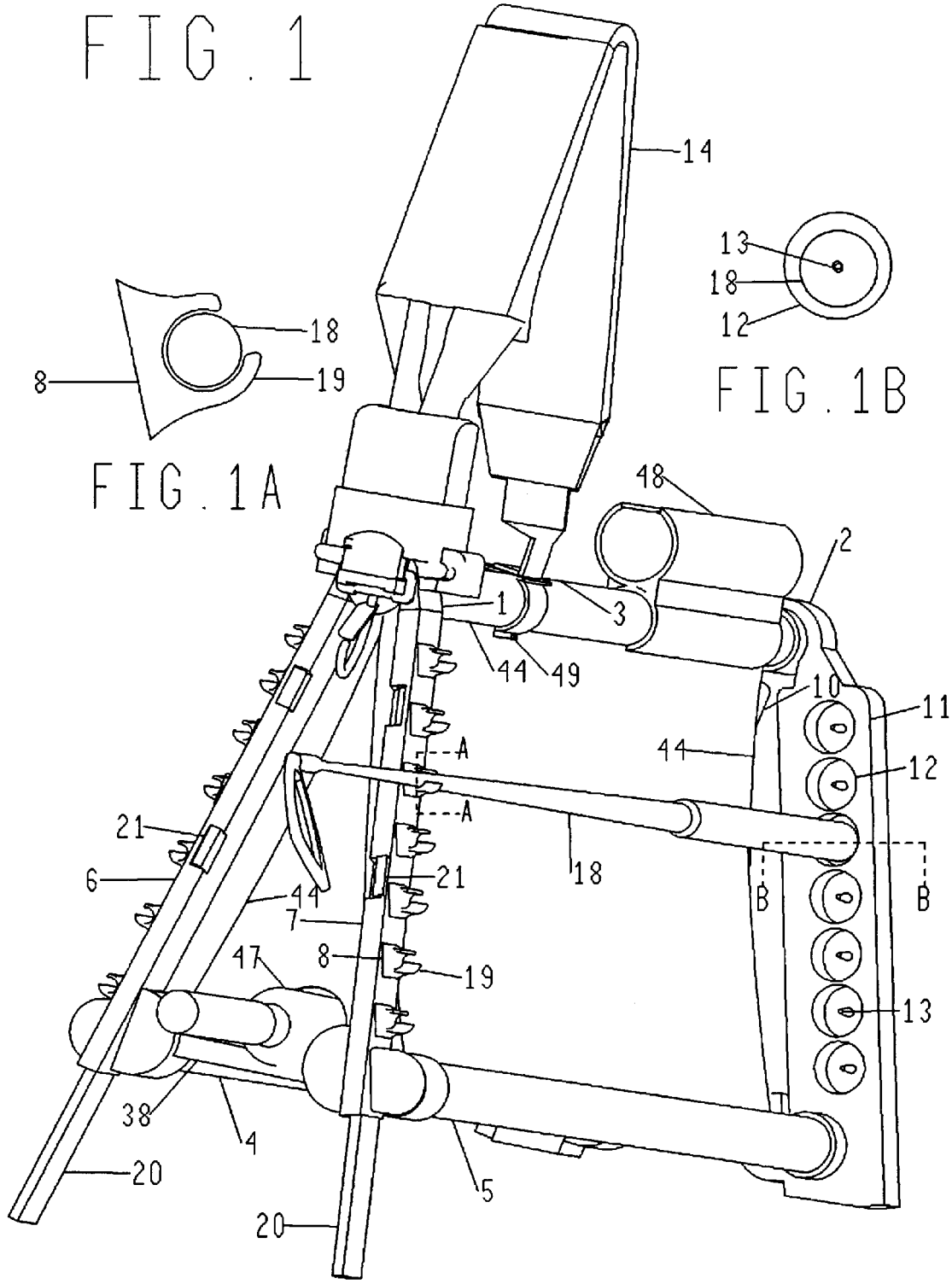
FIG. 1 is a perspective view of the present invention.

FIG. 1 shows two triangular shapes connected at their apex 1 and 2 by a connecting spine 3, which is less than the length of a golf club shaft and grip 18. Additionally, the triangular shapes have their sides connected at their base with connector assemblies 38 and 43 FIG. 5 and with support arms 4 and 5 parallel to the spine 3.

Figures 2, 2A, 2B:
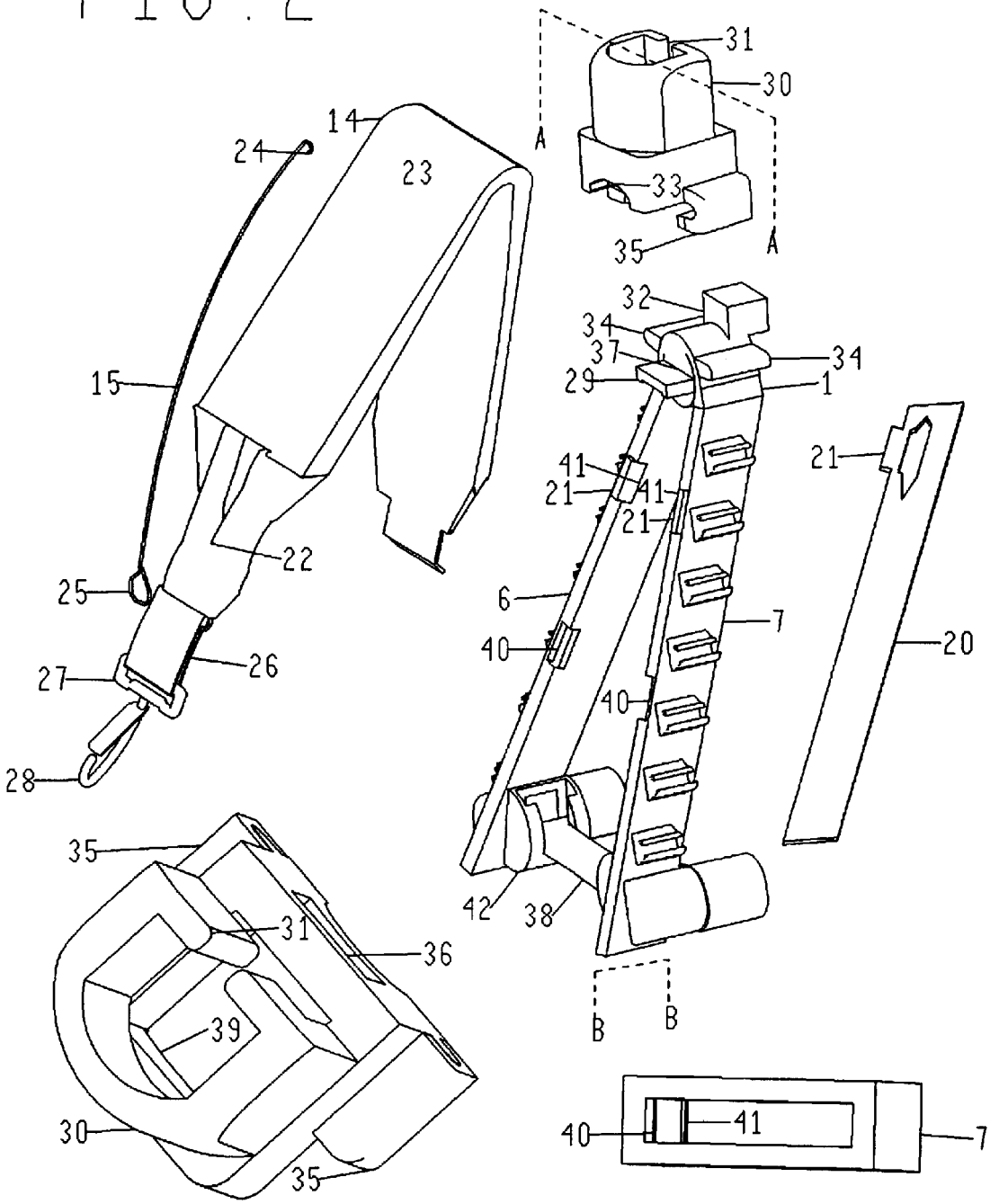
FIG. 2 shows the major components of the present invention requiring interaction for setup and storage.

The front triangular shape 1 has the flat legs 6 and 7 facing out to the side to accommodate seven clips 8 each for holding golf club shafts 18. FIG. 1A shows the clip 8 partially surrounding the shaft 18 to hold it in place and allows the shaft 18 to be released directly away from the flat legs 6 and 7 by having the thumb push down on the lower ridge of the clip 19. The released shaft 18 does not come in contact with the other shafts 18 because the release angle is not vertical. The flat legs 6 and 7 are slightly angled (FIG. 3) away from the spine 3 for stability and to accommodate clips 8 arranged to fit different size club heads. Also, the front triangular shape 1 has slats 20 extending beyond the connector assembly 38 for additional stability, height, and cleanliness in any terrain. FIG. 2 shows the slats 20 retracted for storage. The flat side 6 has the seven clips 8 positioned to accommodate, in order from top to bottom, a putter, sand wedge, pitching wedge, five wood, three wood, driver and another club of any size. The flat side 7 has the seven clips 8 positioned to accommodate irons, in order from top to bottom; nine iron, eight iron, seven iron, six iron, five iron, four iron, and three iron.

Figure 5:
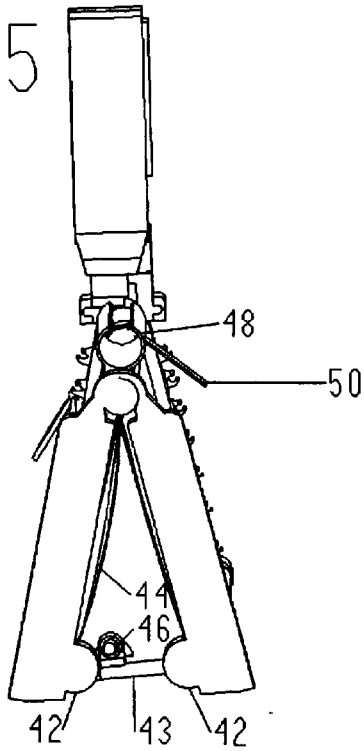
FIG. 5 is a rear view of the present invention.

The rear triangular shape 2 has the flat sides 10 and 11, perpendicular to the spine 3, connected near their base by a rear connector assembly 43 FIG. 5. The rear triangular shape 2 has the flat sides 10 and 11 facing the front, each with seven shallow containers 12, affixed with a small protrusion 13, cone like in nature, in their center for use in securing the golf club grip ends. All golf clubs grips have a small hole at their end. The fourteen shallow containers 12 allow the grip end of the golf club 18 to be held in place, however, the grip end is easily placed in the container 12, as the shallowness of the container does not restrict access. The protrusion 13 inserts into the hole at the grip end of shaft 18. FIG. 1B depicts a front view of the intersection of the grip end of the shaft 18 in the shallow container 12 with the protrusion 13 aligned with the hole at the end of the shaft grip end 18. The shallow containers 12 help position the hole on the shaft grip end 18 to align with the protrusion 13 during normal use when returning the club to the Golf Rack Bag placed in an up right position FIG. 3.

In FIG. 2 a conventional, adjustable, and double padded shoulder strap 14 is inserted with a flexible but sturdy wire 15. The wire 15 is inserted into the strap 14 only once. The end of the wire 15 with the small loop 24 shown in FIG. 2 inserts inside the reinforced nylon webbing at point 22 so that the wire is not visible as it reaches a point 23 inside the strap 14. The other end of the wire 15 terminates with the wire end 25 looping through the strap's connector loop 26. The strap's connector loop 26 connects to a metal buckle 27, which in turn connects to a metal clip 28. The strap's 14 assembly normally connects the clip 28 to a conventional bag. However, in this instance the metal buckle 27 is placed on a protrusion 29 near the apex of the front triangular shape 1 and threaded through a removable housing 30. The removable housing 30 sits at the apex of the front triangular shape 1. When assembled, lifting slowly the strap 14 causes a cinching of the strap 14 to the housing 30 and once done does not need further attention for the Golf Rack Bag's use. A small golf towel could be attached to the clip 28. There are no moving parts when in use and the housing 30 can be removed for storage by reversing the following procedure.

The sequence to attach the strap to the Golf Rack Bag is to place the clip's 28 end down through the top of the housing 30 with the buckle 27 following diagonally. Please reference FIG. 2A. A cutout 31 allows the strap's 14 width up to the insertion point 22 to enter the housing so that the buckle 27 would be lower than the protrusion 29 when the housing 30 is assembled. The strap's 14 width is then cupped around the wire from the connector loop 26 up to the wire insertion point 22. The cupping of the strap's 14 width, from the connector loop 26 to the wire insertion point 22, is accomplished by feeding the width of the strap 14 sideways into the housing 30 through the cutout 31. Once this is done the housing 30 can be placed on the apex of the triangular shape 1. The housing 30 is placed with the bottom inside wall 39 against the top hat 32 protrusion in FIG. 2 and the connector loop 26 is held against the slot top 33 with one's index finger. The slot top 33 provides just enough clearance for the thickness of the connector loop 26. The housing 30 is then slid in the direction of the protrusion 29 by inserting the wing protrusions 34 into the wing receptacles 35 and the top hat 32 protrusion fits flush within the square opening 36 on the housing 30. The buckle 27 is placed on the protrusion 29 against the apex wall 37 on FIG. 2. Beginning with a small degree of lifting pressure on the strap, gradually increasing, a cinching action takes place on the strap within the housing at the apex wall 37 near the slot to 33. The full weight of the clubs can be lifted and the Golf Rack Bag can be maneuvered freely. The full weight and stress of the Golf Rack Bag is on the strap 14 and not on the wire 15. The wire is attached directly to the strap not to the triangular shape 1, however the wire 15 obtains its directionality from the housing 30.

The strap 14 always stands up and the Golf Rack Bag is easily raised using one's hand and arm but there is no need to bend at the waist or at the knees for anyone regardless of their height. Also, the Golf Rack Bag can be easily placed from the shoulder to the ground without any bending or placed in an upright position FIG. 3 without swinging it out to a crash landing, but rather the opposite hand simply guides the Golf Rack Bag onto the rear triangular shape's 2 back using the front connector assembly 38. The design of the Golf Rack Bag distributes the weight of the clubs forward to the golfer's main trunk stem away from the golfer's back compared with conventional carry bags.

Figure 4:
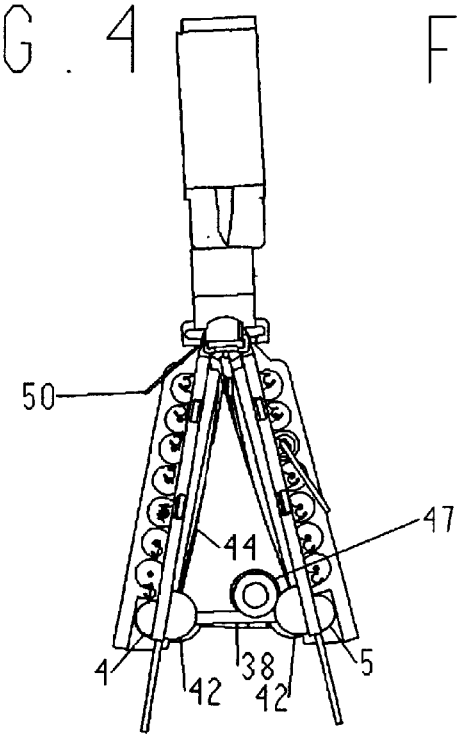
FIG. 4 is a front view of the present invention.

In FIG. 2 the extension slats 20 slide into flat legs 6 and 7. The flat legs 6 and 7 are hollow and contain slots 40 and 41. FIG. 2B is a view from the bottom of flat leg 7 looking up the hollow slot. When the legs are extended the slat protrusion 21 settles in slot 40 and when the legs are retracted the slat protrusion settles in slot 41. The retraction of the slats 20 allows the Golf Rack Bag to be transported in a vehicle without any further disassembly. The slats 20 when extended provide the Golf Rack Bag additional stability, cleanliness in any terrain, and proper height to lift without stooping. FIG. 1 shows the slats 20 extended for use on the golf course. Additional compactness of the Golf Rack Bag for insertion into golf travel bags is obtained by removing the front connector assembly 38 from the front connector assembly holder 42 with a slight tap of the front connector assembly 38 with a club head and then one lifts the released front connector assembly upwards. FIGS. 4 and 5 show the rear connector assembly holders 42 and the rear connector assembly 43. All four connector assembly holders 42 require this procedure to be followed, removing the front 38 and rear 43 connectors, to allow the Golf Rack Bag to be folded to one-half of its triangular span at its base.

Figure 3:
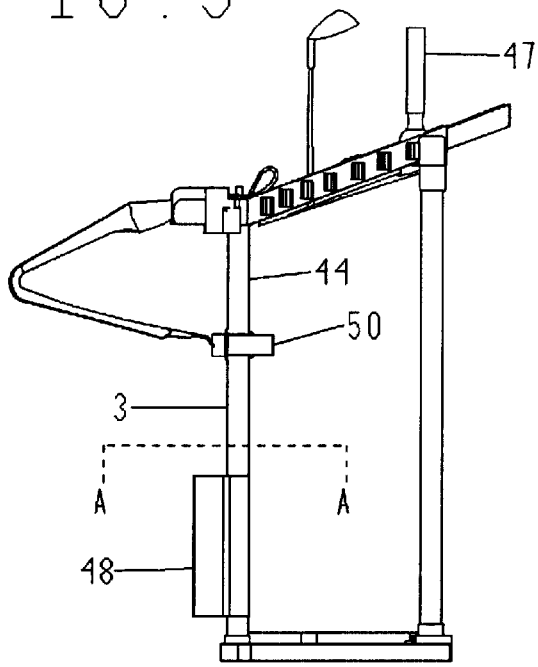
FIG. 3 is an upright view of the present invention.
Figure 3A:
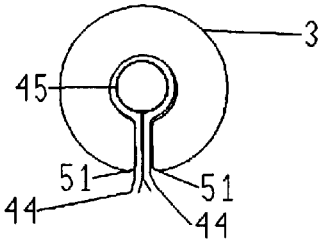

FIG. 3 shows the connecting spine 3 and FIG. 4 shows the support arms 4 and 5, which together provide a framework for a three-sided bag 44 to transport miscellaneous small items, windbreaker, and umbrella. Please reference FIG. 3A. The fabric of the three-sided bag 44 is wrapped around a rod 45 with a diameter less than the diameter of the slot inside the spine 3 and arms 4 and 5 and the fabric exits through a channel 51. The channel is the width of two pieces of three-sided bag 44 fabric thicknesses. The channels 51 in the spine 3 and arms 4 and 5 are angled towards the center of the Golf Rack Bag. The three sides of the three-sided bag 44 fabric are sewn together to form one continuous sheet and are capped at the rear FIG. 5 by stitching. Please reference FIG. 4 showing the front of the three-sided bag 44, which has the sides stitched together at the top intersection and stitched along both the sides and bottom with Velcro sewn in clasps allowing the opening of the bag from either side. A cutout is provided at both ends for the umbrella 47 and at the ends of the spine 3 and support arms 4 and 5. The small end of the umbrella fits in a ring 46 affixed to the rear connector assembly 43. A five-golf ball container 48 is affixed on top of the spine. The strap 14 is adjustable as with any standard strap 14. The free end 50 is inserted in slot 49, referenced in FIG. 1, in the three-sided bag 44 and then the free end 50 is inserted through the standard buckle allowing excess strap material 50 referenced in FIG. 3.

By standing the Golf Rack Bag in an upright position FIG. 3 on the rear triangular shape 2 one can replace a club by inserting the grip end hole of the shaft 18 with a slight push into the empty holder 12 aligned with the protrusion 13. Next the golfer places the shaft 18 of the club within the empty clip 8 with a slight pressure moving the lower ridge of the clip 19 away from the shaft a small fraction of distance. Taking a club out can be done at any time, even while walking, by releasing the lower ridge of the clip 19 with the thumb and continuing with the same hand to pull the golf club 18 shaft slightly forward from the holder 12 and protrusion 13 and away from the open clip 8. The golfer when walking with the Golf Rack Bag on the shoulder may rest the forearm comfortably on the front triangular shape 1 which positions the weight of the Golf Rack Bag to the golfers center of gravity and thereby is lighter than having the weight distributed to the golfers back. The Golf Rack Bag approximates the same storage space as traditional golf bags and it accommodates up to 14 clubs in accordance with USGA rules.

The Golf Rack Bag manufacturing process, material used, and the sequencing of the clubs, clips, and accessory placement can vary and would still be considered as part of this invention. The foregoing is considered as illustrative only of the principals of the invention. Further, since numerous modifications and changes will readily occur, it is not desired to limit the invention to the exact construction shown and described, and accordingly all suitable modifications and equivalents may be resorted to, falling within the scope of the invention as claimed.

What is claimed is:

1. A holder to carry a full set of golf clubs and accessories on one's shoulder and picked up without stooping, each of said golf clubs having a shaft, a shaft grip and a hole on the end of the shaft grip, said holder comprising:

a front triangular frame and a back triangular frame, each of said front and back triangular frames comprising two legs, said legs are connected forming an apex forming one end of each of said front and back triangular frames, a connecting supporting assembly connecting said legs at the other end of each of said front and back triangular frames;

a connecting spine connecting said front and back triangular frames at their respective apexes;

parallel support arms connecting the other ends of said front and back triangular frames on two sides; said support arms being substantially parallel to said spine;

each of said legs of said front triangular frame having a flat side facing a side of said holder, said flat side having a plurality of clips for accommodating the golf clubs, each of said clips adapted to partially surrounding the shaft of the respective club, each of said legs of said front triangular frame being hollow and comprising a plurality of slots;

a plurality of slats, each slat adapted to be received within the respective leg on said front triangular frame and adapted to engage with said slots of said respective leg;

each of said legs of said rear triangular frame having a flat side facing a front of said holder, said flat side having a plurality of shallow portions formed therein, each of said shallow portion having a cone shaped protrusion at its center, said shallow portion adapted to help aligning said cone shaped protrusion with the hole on the end of the shaft grip.

* * * * *